US008262074B2

(12) United States Patent
Langenegger

(10) Patent No.: US 8,262,074 B2
(45) Date of Patent: Sep. 11, 2012

(54) DEVICE FOR COLLECTING PRINTED SHEETS

(75) Inventor: Daniel Langenegger, Brittnau (CH)

(73) Assignee: Mueller Martini Holding AG, Hergiswil (CH)

( * ) Notice: Subject to any disclaimer, the term of this patent is extended or adjusted under 35 U.S.C. 154(b) by 210 days.

(21) Appl. No.: 12/251,982

(22) Filed: Oct. 15, 2008

(65) Prior Publication Data

US 2009/0224457 A1 Sep. 10, 2009

(30) Foreign Application Priority Data

Oct. 19, 2007 (EP) ..... 07405314

(51) Int. Cl.
*B65H 39/00* (2006.01)

(52) U.S. Cl. ..... 270/52.22; 270/52.14; 270/52.16; 270/52.19; 270/58.27; 270/58.29

(58) Field of Classification Search ..... 270/52.14, 270/52.16, 52.18, 52.19, 52.2, 52.21, 52.22, 270/58.27, 58.29; 271/220, 292, 294
See application file for complete search history.

(56) References Cited

U.S. PATENT DOCUMENTS

| | | | | |
|---|---|---|---|---|
| 1,192,561 | A * | 7/1916 | Reiser | 270/52.16 |
| 3,664,655 | A * | 5/1972 | McCain et al. | 270/56 |
| 4,494,742 | A * | 1/1985 | Guenther et al. | 270/58.29 |
| 4,588,179 | A | 5/1986 | Gutierrez | |
| 4,981,291 | A * | 1/1991 | Honegger et al. | 270/52.3 |
| 5,716,190 | A * | 2/1998 | Rathert | 414/794.3 |
| 5,876,029 | A * | 3/1999 | Wright et al. | 271/3.18 |
| 5,887,863 | A * | 3/1999 | Hollenstein et al. | 270/52.18 |
| 7,547,008 | B2 * | 6/2009 | Belanger | 270/52.15 |
| 7,588,239 | B2 * | 9/2009 | Marcinik et al. | 270/52.18 |
| 2005/0184441 | A1 * | 8/2005 | Munneke | 270/52.14 |

FOREIGN PATENT DOCUMENTS

| | | | |
|---|---|---|---|
| EP | 337 315 | A2 | 10/1989 |
| EP | 1 726 552 | A1 | 11/2006 |
| EP | 1 918 232 | A1 | 5/2008 |
| WO | WO-2007/085101 | A1 | 8/2007 |

OTHER PUBLICATIONS

European Office Action (with translation), dated Nov. 26, 2009, issued in related European Application No. 07 405 314.1.
European Search Report (with translation) dated Jan. 4, 2008 issued in Priority Application No. 07405314.1.

* cited by examiner

*Primary Examiner* — Leslie A Nicholson, III
(74) *Attorney, Agent, or Firm* — Venable LLP; Robert Kinberg

(57) ABSTRACT

A plurality of conveying elements is arranged on a traction device of a conveying arrangement in spaced apart succession in a conveying direction. Each conveying element includes a support surface and an end stop coupled to a front of the support surface, positioned perpendicular to the support surface and transverse to the conveying direction. The conveying elements are guided at least while in a feed region of respective feed devices that feed printed sheets to the conveying elements. The support surfaces of the conveying elements are aligned parallel to the conveying direction on the feed section. A holding down device located at a downstream end in the conveying direction of the feed region of each of the feed devices holds down and guides the book block from above while conveyed on the conveying element.

13 Claims, 3 Drawing Sheets

DEVICE FOR COLLECTING PRINTED SHEETS

CROSS-REFERENCE TO RELATED APPLICATION

This application claims the priority of European patent document 07405314.1, filed on Oct. 19, 2007, the subject matter of which is incorporated herein by reference in its entirety.

BACKGROUND OF THE INVENTION

The invention relates to a device for collecting printed sheets into non-bound book blocks along a horizontal feed section, including a conveying arrangement with a circulating traction device. The device also includes successively mounted and spaced apart conveying elements for accommodating the printed sheets. The printed sheets are arranged on the circulating traction device. Above-positioned feed devices for the printed sheets are also provided which are mounted successively in the conveying direction along the traction device. The conveying elements, which are guided in at least one feed region for the printed sheets, are embodied as support surfaces for the collected, stacked sheets. The support surfaces have an end stop at the front end in the circulating or conveying direction and the end stop extends transverse to the conveying direction.

Collecting devices of the aforementioned type are used in industrial bookbinding operations for collecting printed sheets into loose stacks (book blocks). In the process, the various printed sheets are collected in a predetermined sequence and are then transferred to a different machine for the further processing, for example to a perfect binder, where they are bound to form unfinished books, catalogs, brochures, or similar printed products. The collecting devices disclosed in some references are provided with a conveying arrangement consisting of a circulating traction device with uniformly spaced-apart conveying elements mounted thereon. Feed devices are positioned along the conveying arrangement, which generally feed respectively one printed sheet to the conveying elements of the conveying arrangement during each operating cycle. The conveying elements are essentially embodied as supports onto which the printed sheets are deposited with their flat sides down or on which they are stacked and are provided with an end stop positioned perpendicular to the support surface, which is designed for aligning the sheets. A defined type of printed sheets is stored in each feed device, of which respectively one is supplied to the conveying elements passing by, so that when reaching the end of the conveying arrangement the conveying elements carry loose book blocks composed of individual sheets.

European patent document 1 726 552 A1 discloses an apparatus, designed to be used for processing printed sheets, which is provided with conveying elements having a wall at the front end in conveying direction and support surfaces that are slanted toward this wall, at least in the region of the conveying or feed section. The angle $\beta$ formed by the conveying direction L and the slanted support surface is smaller than the feed angle $\alpha$ between the conveying direction L and the feed direction F of the feed devices. This type of arrangement is based on the idea of positioning the printed sheets, which are supplied by the feed devices from above and at an angle in a downward direction, in approximately the same slanted position on the support surfaces of the conveying elements.

Tests carried out with this type of arrangement have shown, however, that positioning the surfaces of the conveying elements at a slant does not work if the weight of the individual printed sheets to be collected differs considerably. For example, if a more light-weight sheet is supplied to the support surface and a relatively heavy printed sheet is then pushed on top of this sheet, the heavier sheet pushed on top can displace the sheet underneath in the region along the end stop because of the frictional engagement.

This problem cannot be corrected, not even with an embodiment as disclosed in International Patent Application Publication No. WO 2007/085101 A1, which stipulates that the support surfaces of the conveying elements driven along a circular path must be embodied to be at an angle in the conveying direction, at least in the feed region for the printed sheets, or must be placed at an angle. However, it is possible that the slanted position of the conveying element support surfaces may help the movement of the printed sheets into the conveying elements.

European patent document 1 726 552 A1 and International Patent Application Publication No. WO 2007/085101 A1 obviously proceed on the assumption that the feeding, collecting, and aligning of the printed sheets on the support surfaces of the conveying elements can be aided by positioning these at an angle. This opinion is incorrect because experience has shown that the printed sheets cannot be reliably aligned and collected on the slanted support surfaces of the conveying elements, such that they rest thereon.

SUMMARY

It is therefore an object of the present invention to create a device of the aforementioned type, which permits a secure aligning of the printed sheets along the side edge in front, as seen in conveying direction, regardless of the condition of the printed sheets. The present invention takes a different and surprising path by making it possible to pick up all types of printed sheets, while aligned, and to transfer these reliably to the following processing station.

The above and other objects are accomplished according to an aspect of the invention wherein there is provided, a device for collecting printed sheets into non-bound book blocks along a horizontal feed section, comprising: a conveying arrangement including a circulating traction device; a plurality of feed devices arranged above and successively along the conveying arrangement to feed printed sheets; a plurality of conveying elements arranged on the traction device in spaced apart succession in a conveying direction of the conveying arrangement, each conveying element including a support surface to support collected, stacked printed sheets received from the feed devices and an end stop coupled to a front of the support surface as seen in the conveying direction, positioned perpendicular to the support surface and transverse to the conveying direction, the conveying elements are guided at least while in a feed region of the respective feed devices for the printed sheets and the support surfaces of the conveying elements are aligned parallel to the conveying direction on the feed section; and a holding down device located at a downstream end in the conveying direction of the feed region of each of the feed devices for the printed sheets, the holding down device holding down and guiding the book block from above while conveyed on the conveying element.

BRIEF DESCRIPTION OF THE DRAWINGS

The present invention will be more readily understood from the following detailed description when read in conjunction with the accompanying drawings, in which.

DETAILED DESCRIPTION

Figure 1:
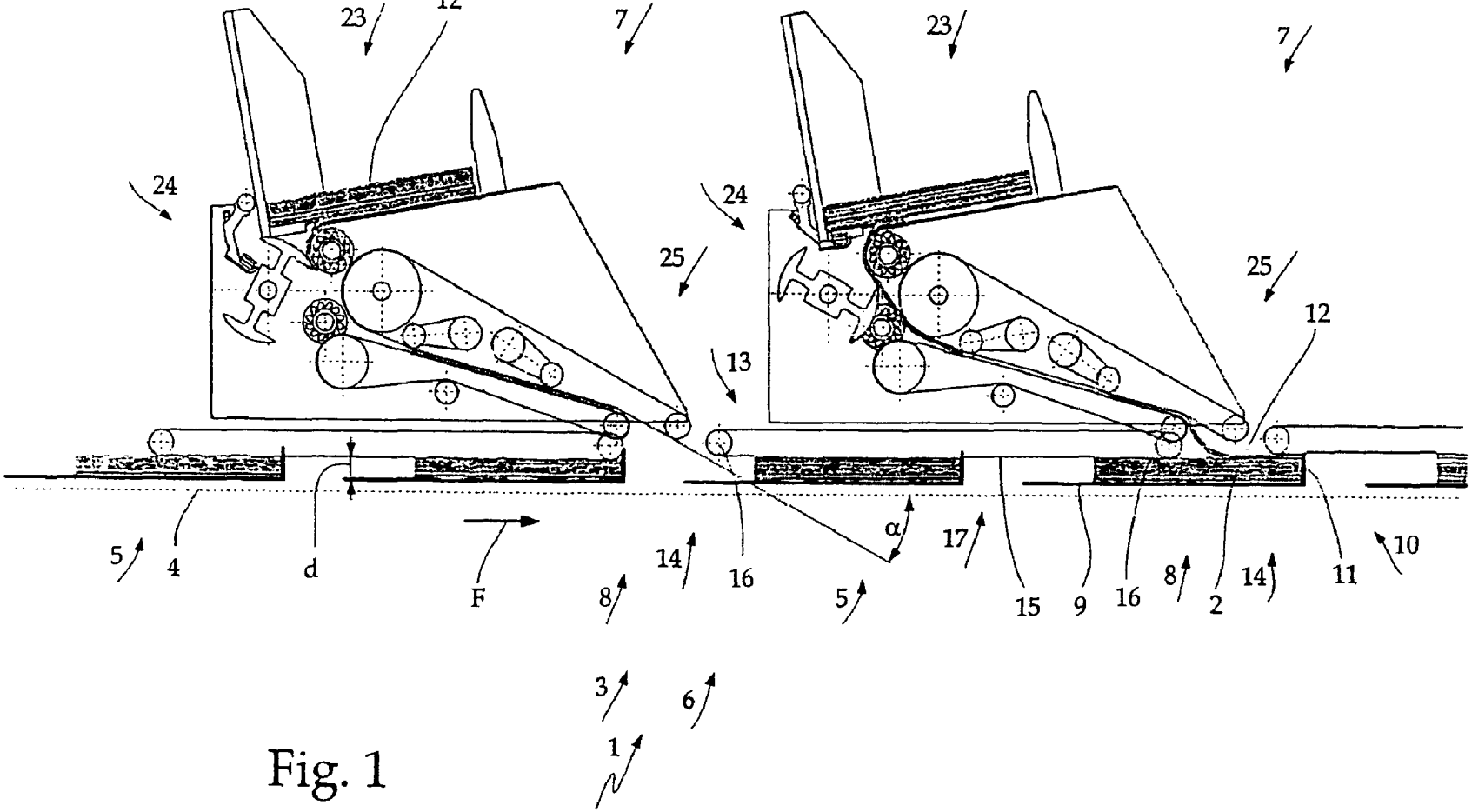
FIG. 1 is a detail of a view from the side of a device for collecting printed sheets according to one embodiment of the invention.

Referring to FIG. 1, there is shown an embodiment of a device 1 for collecting printed sheets 12 into non-bound book blocks 2 along a horizontal feed section 3 with a conveying arrangement 6, including a circulating traction device 4 with thereon successively mounted, spaced-apart conveying elements 5 for accommodating the printed sheets 12. Feed devices 7 are positioned above the conveying arrangement 6, successively arranged in the conveying direction F, which comprise for example a magazine 23 for holding the printed sheets 12, a separating device 24, and a feed conveyor 25. The separating device 24 lifts off and grips the respectively lowest sheet in the stack with the aid of suction devices, pulls it out from under the stack, and transfers it to the feed conveyor 25. The feed conveyor 25, which is positioned at an acute angle $\alpha$ to the conveying direction F of the conveying arrangement, transfers the printed sheets 12 in a feed region 8, formed by the feed direction and the conveying direction F, to the conveying elements 5 of the conveying arrangement 6.

The conveying elements 5 include a support surface 9 for the stacked printed sheets 12, as well as an upright positioned end stop 11 that extends transverse to the conveying direction F. The end stop 11 is embodied on the front end 10 in the circulating or conveying direction F of the support surface 9. On the feed section 3, the support surfaces 9 of the conveying elements 5 may be aligned at least approximately parallel to the conveying direction F. The printed sheets 12 that are supplied by the conveying arrangement 6 may be deposited on the support surface or in the conveying elements 5 with a speed that exceeds the speed of the conveying arrangement 6. As a result, the printed sheets 12 impact in the feed region 8 with the end stop 11 or they are aligned against the end stop 11.

Figure 2:
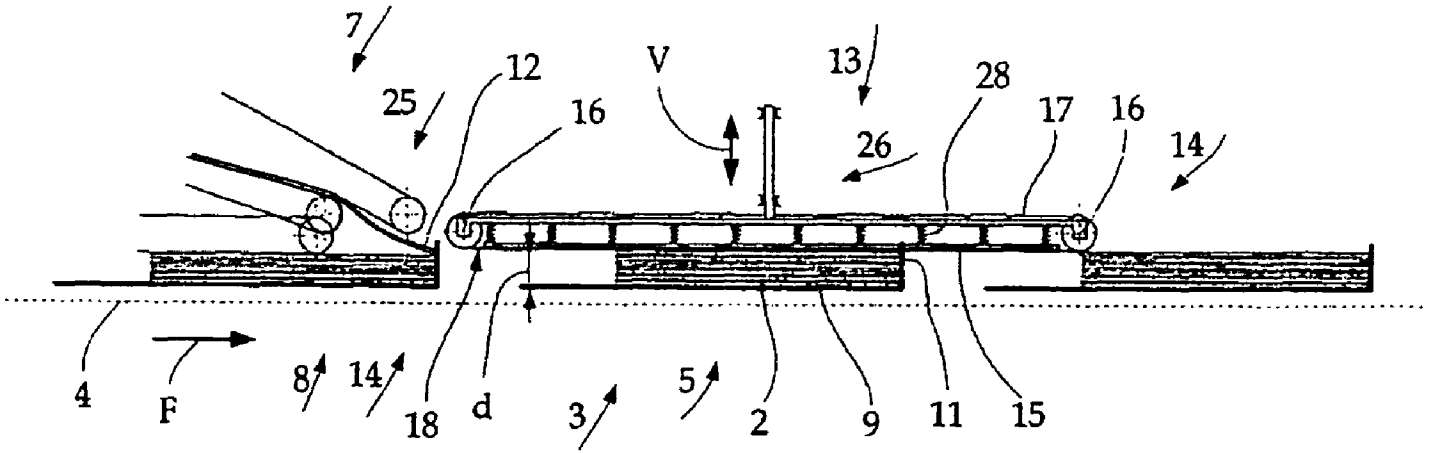
FIG. 2 is another embodiment of a holding down device according to the invention.

A holding down device 13 is respectively arranged at the downstream end 14, as seen in conveying direction F, of the feed region 8, wherein this holding down device accompanies and acts upon the printed sheets 12 from above and extends at least nearly to the feed region 8 of the feed device 7 that follows in the conveying direction F (see FIG. 2). As shown in this embodiment, the holding down device 13 is a lower belt section 15 with at least one belt 17, which circulates around two axes 16 that are arranged at a distance to each other in the conveying direction F. The speed of the lower belt section 15 or the holding down device 13 in conveying direction F is at least nearly as high as the speed of the conveying arrangement 6.

To minimize the frictional forces between the book blocks 2 and the belt 17, the outer surface 18 may be embodied to be smooth. To compensate for the thickness tolerances of the non-bound book blocks 2 in the conveying elements 5, the holding down device 13 may be pressed with a variable force against the book blocks 2. This force can be generated with the aid of springs 28 or with pneumatic cylinders. During the collecting operation, the book blocks 2 increase in thickness with each supplied printed sheet 12. To compensate for these thickness differences, a spacing "d" between the support surfaces 9 and the holding down device 13 is changeable, meaning the height of the holding down device 13 or the support surface 9 of the conveying element 5 can be adjusted.

Figure 5:
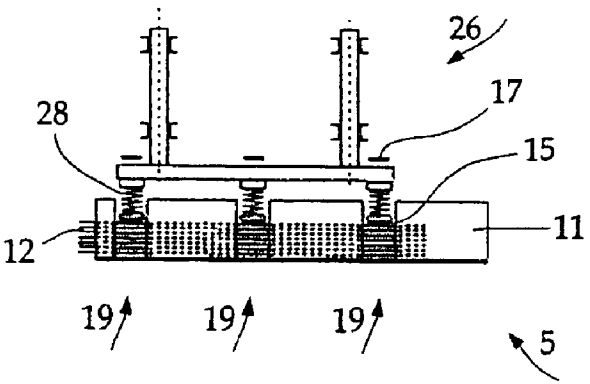
FIG. 5 is a cross section through the end stop shown in FIG. 2, as seen transverse to the conveying direction.

In FIG. 2, for example, the holding down device 13 is guided to be adjustable in the direction V, relative to the support surfaces 9 of the conveying elements, by using a locally fixed guide arrangement 26. According to FIG. 5, the holding down device 13 or the lower belt section 15 extends through the upright positioned end stop 11 on the conveying elements 5. For this purpose, the end stop 11 is therefore provided with recesses 19 that extend downward from the upper end in the region of the holding down device 13.

Figure 3:
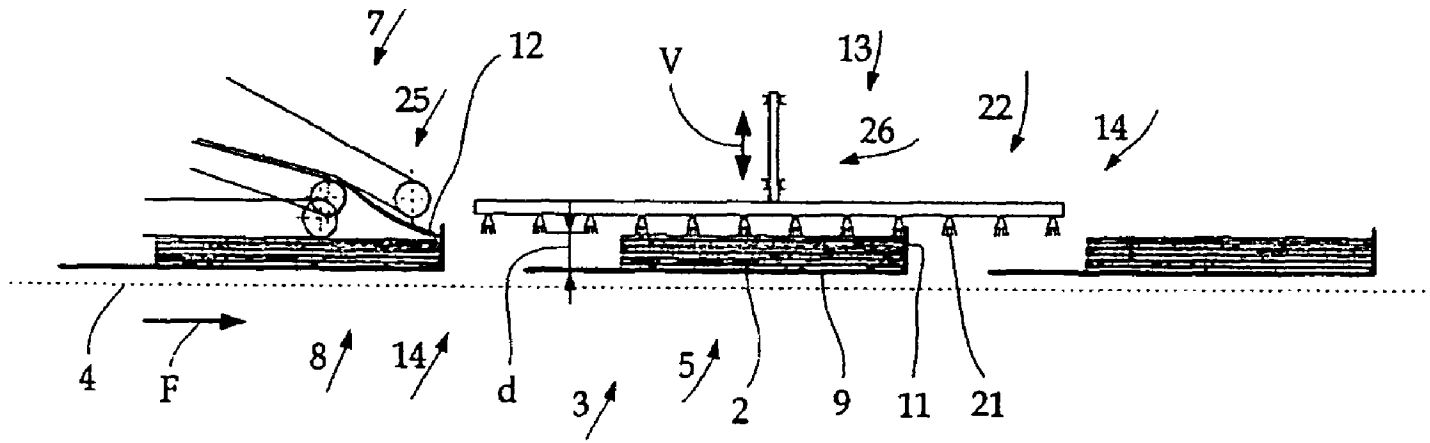
FIG. 3 is a further embodiment of a holding-down device according to the invention.

FIG. 3 shows a different embodiment of the holding down device 13. The printed sheets 12 are pressed against each other and against the support surfaces 9 of the conveying elements 5 with the aid of blast air 21, supplied by a nozzle arrangement 22. The force generated in this way causes frictional forces between the printed sheets 12 as well as between the support surface 9 and the book block 2, which prevent a displacement of the printed sheets 12 or the book block 2.

Figure 4:
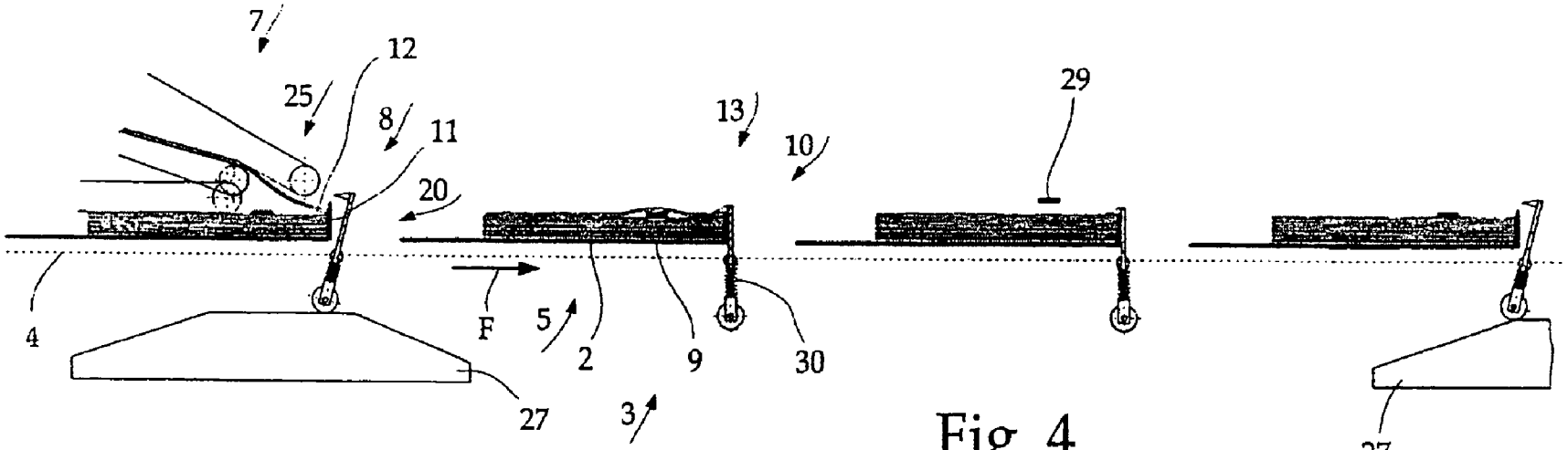
FIG. 4 is a yet another embodiment of a holding-down device according to the invention.

According to an alternative embodiment shown in FIG. 4, the holding down device 13 is embodied as a clamp 20, arranged at the front end 10 of the conveying element 5 in circulating or conveying direction F, which acts from above on the collected printed sheets 12 and is controlled to open and close. The clamp 20 is opened before a conveying element 5 reaches the feed region 8, so that a printed sheet 12 can be supplied to the end stop 11 of the conveying element 5. The clamp 20 is closed once the printed sheet 12 (adjusted) rests against the end stop 11. This operational sequence is repeated for each feed device 7. To control the clamp 20, guide rails 27 are provided in the feed regions 8, which make it possible to open the clamps 20 counter to a clamping force, generated by a clamping spring 30.

An additional holding down device 29, which is controlled and moves along with the conveying elements 5, can hold a book block 2 against the support surface 9 if the clamp 20 is opened and can thus prevent a displacement of the book blocks 2 or parts thereof. The intention is to press the holding down device 29 with a spring force against the support surface 9, wherein the holding down device 29 can be activated with analog devices such as the ones described for controlling the clamps 20, but not shown herein. However, it is not absolutely necessary for the holding down devices 29 to be attached to the conveying elements 5. It is furthermore conceivable to attach these devices to a system, moving synchronously along with the conveying elements 5, e.g. to a circulating traction device.

It will be understood that the above description of the present invention is susceptible to various modifications, changes and adaptations, and the same are intended to be comprehended within the meaning and range of equivalents of the appended claims.

What is claimed is:

1. A device for collecting printed sheets into non-bound book blocks along a horizontal feed section, comprising:

a horizontal conveying arrangement including a circulating traction device;

a plurality of feed devices arranged above and successively along the horizontal conveying arrangement in the horizontal feed section to feed printed sheets;

a plurality of conveying elements arranged on the traction device in spaced apart succession in a conveying direction of the horizontal conveying arrangement, each conveying element including a support surface to support collected, stacked printed sheets received from the feed devices and an end stop coupled to a front of the support surface as seen in the conveying direction, positioned perpendicular to the support surface and transverse to the conveying direction, the conveying elements are guided at least while in a feed region of the respective feed devices for the printed sheets and the support surfaces of the conveying elements are aligned parallel to the conveying direction on the feed section;

first holding down devices each comprising a clamp arranged on a front end of each respective conveying element as seen in the conveying direction, wherein each clamp clamps the collected printed sheets and is controllable to open and close; and second holding down devices adapted to move along with the conveying elements in the conveying direction, wherein each second holding down device is adapted to hold the book block down against the support surface of the respective conveying element from above when the respective clamp is open.

2. The device according to claim 1, wherein each second holding down device is locally fixed to a respective conveying element.

3. The device according to claim 2, wherein each second holding down device extends at least approximately to the feed region for the feed device that follows in conveying direction.

4. The device according to claim 3, wherein each second holding down device comprises a lower belt section, the lower belt section comprises at least one belt and two axes which are arranged at a distance to each other in conveying direction, and the belt circulates around the two axes.

5. The device according to claim 4, wherein the at least one belt has a smooth outside.

6. The device according to claim 4, wherein the lower belt section moves at a speed that is approximately at least the same speed as the conveying element.

7. The device according to claim 4, wherein the end stop includes recesses extending downward from an upper end of the end stop in a region of each second holding down device.

8. The device according to claim 2, wherein each second holding down device comprises a nozzle arrangement to blow air onto the printed sheets.

9. The device according to claim 1, further comprising a spacing between the support surface and each second holding down device, wherein the spacing is adjustable.

10. The device according to claim 9, wherein each second holding down device is adapted to permit adjustment of the distance to the support surface.

11. The device according to claim 1, wherein each second holding down device is adapted to place a variable force onto the collected printed sheets.

12. A device for collecting printed sheets into non-bound book blocks along a horizontal feed section, comprising:

a conveying arrangement including a circulating traction device;

a plurality of feed devices arranged above and successively along the conveying arrangement to feed printed sheets;

a plurality of conveying elements arranged on the traction device in spaced apart succession in a conveying direction of the conveying arrangement, each conveying element including a support surface to support collected, stacked printed sheets received from the feed devices and an end stop coupled to a front of the support surface as seen in the conveying direction, positioned perpendicular to the support surface and transverse to the conveying direction, the conveying elements are guided at least while in a feed region of the respective feed devices for the printed sheets and the support surfaces of the conveying elements are aligned parallel to the conveying direction on the feed section; and a locally fixed holding down device located at a downstream end in the conveying direction of the feed region of each of the feed devices for the printed sheets, wherein the holding down device extends at least approximately to the feed region for the feed device that follows in conveying direction the holding down device holding down and guiding the book block from above while conveyed on the conveying element, wherein the holding down device comprises:

a lower belt section, the lower belt section comprising at least one belt and two axes which are arranged at a distance to each other in conveying direction, and the belt circulates around the two axes, wherein the end stop further includes recesses extending downward from an upper end of the end stop in a region of the holding down device.

13. A device for collecting printed sheets into non-bound book blocks along a horizontal feed section, comprising:

a conveying arrangement including a circulating traction device;

a plurality of feed devices arranged above and successively along the conveying arrangement to feed printed sheets;

a plurality of conveying elements arranged on the traction device in spaced apart succession in a conveying direction of the conveying arrangement, each conveying element including a support surface to support collected, stacked printed sheets received from the feed devices and an end stop coupled to a front of the support surface as seen in the conveying direction, positioned perpendicular to the support surface and transverse to the conveying direction, the conveying elements are guided at least while in a feed region of the respective feed devices for the printed sheets and the support surfaces of the conveying elements are aligned parallel to the conveying direction on the feed section; and a locally fixed holding down device located at a downstream end in the conveying direction of the feed region of each of the feed devices for the printed sheets, the holding down device holding down and guiding the book block from above while conveyed on the conveying element, wherein the holding down device comprises a nozzle arrangement to blow air onto the printed sheets.

* * * * *